US007032873B2

(12) United States Patent
Phaneuf

(10) Patent No.: US 7,032,873 B2
(45) Date of Patent: Apr. 25, 2006

(54) DEMOUNTABLE DEVICE BRACKET

(76) Inventor: Peter F. Phaneuf, 179 Middle Rd., Southborough, MA (US) 01772

( * ) Notice: Subject to any disclaimer, the term of this patent is extended or adjusted under 35 U.S.C. 154(b) by 15 days.

(21) Appl. No.: 10/938,454

(22) Filed: Sep. 10, 2004

(65) Prior Publication Data

US 2005/0061945 A1 Mar. 24, 2005

Related U.S. Application Data

(60) Provisional application No. 60/501,904, filed on Sep. 10, 2003.

(51) Int. Cl.
*A47G 25/12* (2006.01)

(52) U.S. Cl. ..... 248/538; 40/607.09

(58) Field of Classification Search ..... 248/538, 248/539, 534, 540, 541, 535, 231.9; 40/601, 40/607.01, 607.09
See application file for complete search history.

(56) References Cited

U.S. PATENT DOCUMENTS 3,920,207 A * 11/1975 Adamaitis ..... 248/538
4,523,357 A * 6/1985 Widditsch ..... 24/600.9
RE35,731 E * 2/1998 Lach ..... 248/535
6,726,170 B1 * 4/2004 Luo ..... 248/538
6,857,614 B1 * 2/2005 Fox ..... 248/535

* cited by examiner

*Primary Examiner*—Ramon O Ramirez
(74) *Attorney, Agent, or Firm*—Brian M. Dingman, Esq.; Mirick, O'Connell, DeMallie & Lougee

(57) ABSTRACT

A demountable device bracket having a bracket receiver tube adapted to be fixed to a surface, and defining an upwardly-facing opening having an opening shape. There is a bracket assembly with a bracket mounting bar having generally the shape of the opening in the bracket receiver tube, and sized to slide down into the upwardly-facing opening of the bracket receiver tube. There is also a hanger-receiving tube extending at an angle from the exposed portion of the mounting bar, defining an opening that can receive a pole or bar, and a lifting bar extending downward from the hanger-receiving tube. The bracket mounting bar can be slid into the bracket receiver tube, to allow a pole or bar that is inserted into the hanger-receiving tube and that carries an object such as a flag, banner or birdfeeder, for example, to be removably held above the ground.

16 Claims, 20 Drawing Sheets

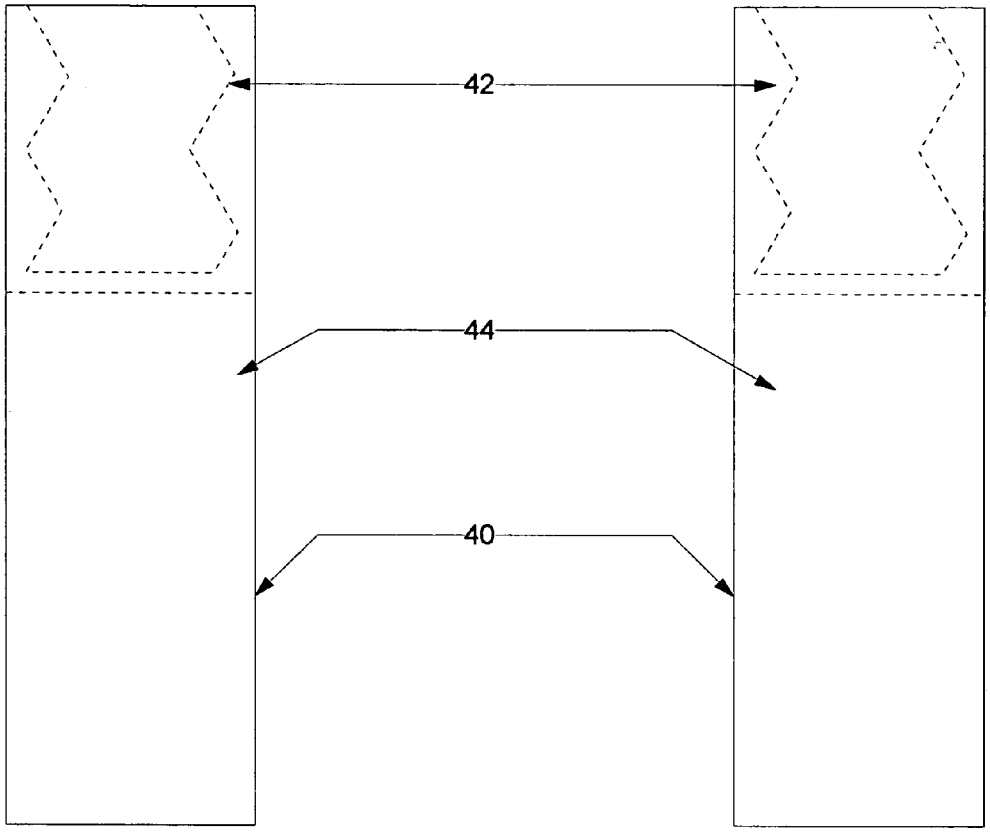
FIG. 6A
FIG. 6B
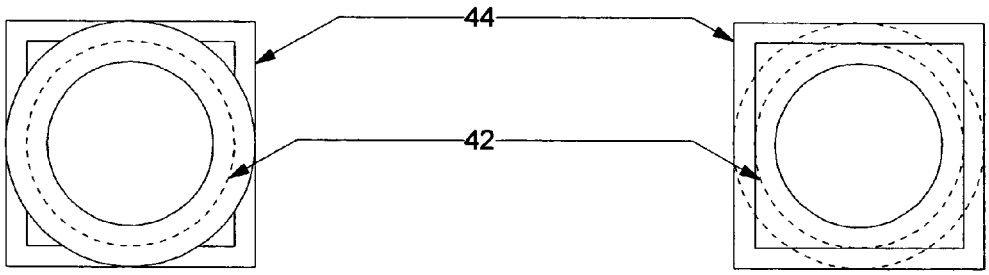
FIG. 6C
FIG. 6D 34
35
34
32
33
30
13
12
20
22
24

SHEET 1 OF 2

35
32
33

34

30
33
13
22
12
11
24

10

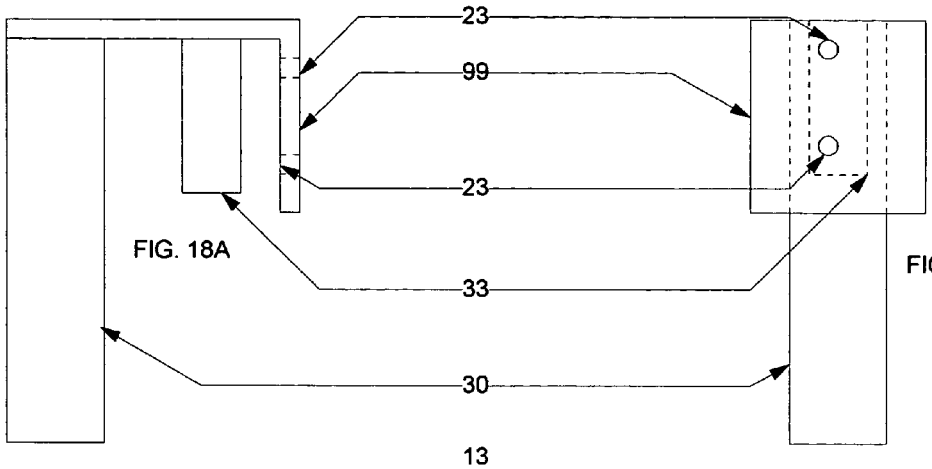
FIG. 18A
FIG. 18B
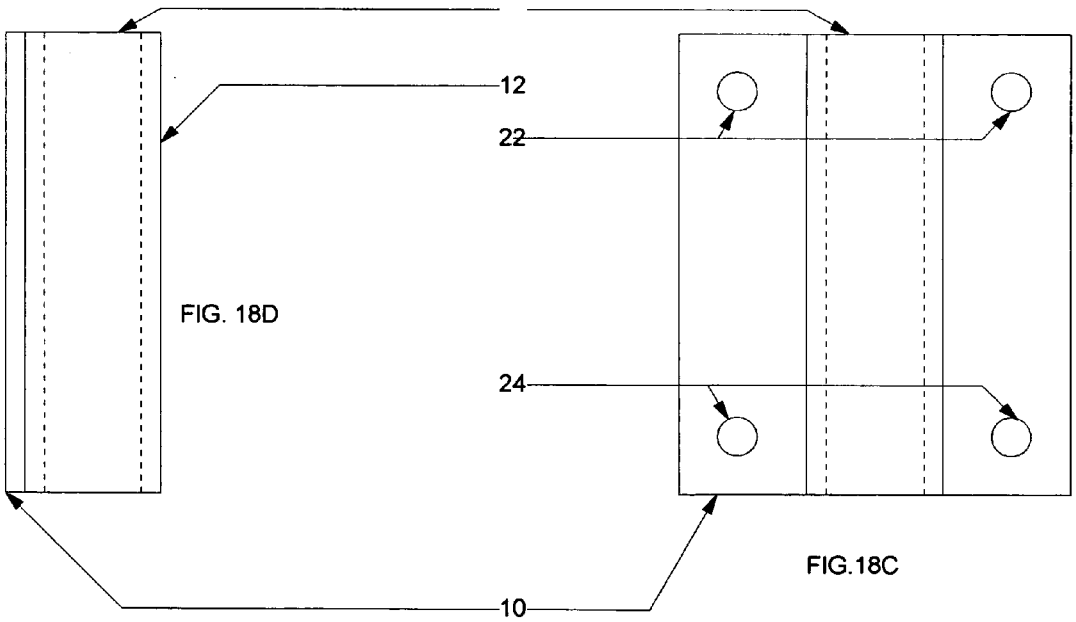
FIG. 18D
FIG.18C

DEMOUNTABLE DEVICE BRACKET

CROSS REFERENCE TO RELATED APPLICATION

This application claims priority of Provisional application Ser. No. 60/501,904, filed on Sep. 10, 2003.

FIELD OF THE INVENTION

This invention relates to a bracket for flag poles and the like.

BACKGROUND OF THE INVENTION

Flags and banners are commonly mounted to utility poles. In order for the flags or banners to be above the height of people, bicyclists, cars and trucks passing underneath, the bracket must be mounted well above the height any person can reach. Accordingly, the devices are typically mounted by firefighters or town public works employees using appropriate equipment such as fire trucks or cherry pickers. As a result, the installation is difficult and expensive to accomplish.

There is also a need for homeowners to mount flag poles, plant hangers, bird feeders and other objects to houses, trees and the like. Most times, this installation is permanent or semi-permanent, using screws or bolts to mount the device to a surface. Consequently, it is difficult to install and replace the mounted object.

SUMMARY OF THE INVENTION

This invention comprises a demountable device bracket that is adapted to allow a user to hang an object from the surface, in which the hanging point can be above the user's head. Any device that the user desires to hang from and remove from a surface can be mounted using the invention. Typical uses include flagstaffs, banners, birdhouses, plant hangers and the like.

This invention features a demountable device bracket. One embodiment has a bracket receiver tube adapted to be fixed to a surface, and defining an upwardly-facing opening having an opening shape. There is a bracket assembly comprising a bracket mounting bar having generally the shape of the opening in the bracket receiver tube, and sized to slide down into the upwardly-facing opening of the bracket receiver tube. There is also a hanger-receiving tube extending at an angle from the exposed portion of the mounting bar, defining an opening that can receive a pole or bar, and a lifting bar extending downward from the hanger-receiving tube. The bracket mounting bar can be slid into the bracket receiver tube, to allow a pole or bar that is inserted into the hanger-receiving tube and that carries an object such as a flag, banner or birdfeeder, for example, to be removably held above the ground.

The demountable device bracket may further comprise an elongated lifter comprising a lifting head assembly adapted to couple with the lifting bar, wherein the lifter supports the bracket assembly for lifting, so that the bracket mounting bar can be lifted to a bracket receiver tube above the user's head. The bracket receiver tube may define a generally rectangular opening or a generally square opening. The bracket receiver tube may define a locking structure. The lifting bar may be generally rectangular.

The hanger-receiving tube may define a generally round opening. The hanger-receiving tube may further include a set screw device for maintaining a structure therein. The hanger-receiving tube may be at an angle or may be horizontal.

The demountable device bracket may further comprise a mounting bracket coupled to the bracket receiver tube. The mounting bracket may define one or more openings through which are placed one or more strap clamps, to allow the device bracket to be coupled to a pole around which the strap clamp is passed. The demountable device bracket may further comprise a universal mounting device held in the hanger-receiving tube and comprising a short tube and an extending portion to which can be coupled another structure.

Featured in another embodiment of the invention is a demountable device bracket comprising a bracket receiver tube adapted to be fixed to a surface, and defining an upwardly-facing opening having an opening shape, and a bracket assembly comprising a bracket mounting bar having generally the shape of the opening in the bracket receiver tube, and sized to slide into the upwardly-facing opening of the bracket receiver tube, an adapter extending from the exposed portion of the mounting bar, to which another structure can be coupled, and a lifting bar extending downward. The bracket mounting bar can be slid into the bracket receiver tube, to allow a structure that is coupled to the adapter to be removably held above the ground. The lifting bar may be integral with and below the adapter. This embodiment may also include an elongated lifter comprising a lifting head assembly adapted to couple with the lifting bar, wherein the lifter supports the bracket assembly for lifting, so that the bracket mounting bar can be lifted to a bracket receiver tube above the user's head.

BRIEF DESCRIPTION OF THE DRAWINGS

Other objects, features and advantages will occur to those skilled in the art from the following description of the preferred embodiments, and the accompanying drawings, in which:

FIGS. 5A, 5B, 6A–6D are views of the preferred embodiment of the elongated lifter for lifting the bracket assembly above a user's head;

FIGS. 12A and 12B are side and front views, respectively, of another embodiment that accomplishes a device for hanging plants and the like;

FIGS. 18A–18D show yet another embodiment for existing devices such as flagstaff holders.

DESCRIPTION OF THE PREFERRED EMBODIMENTS

Figure 1:
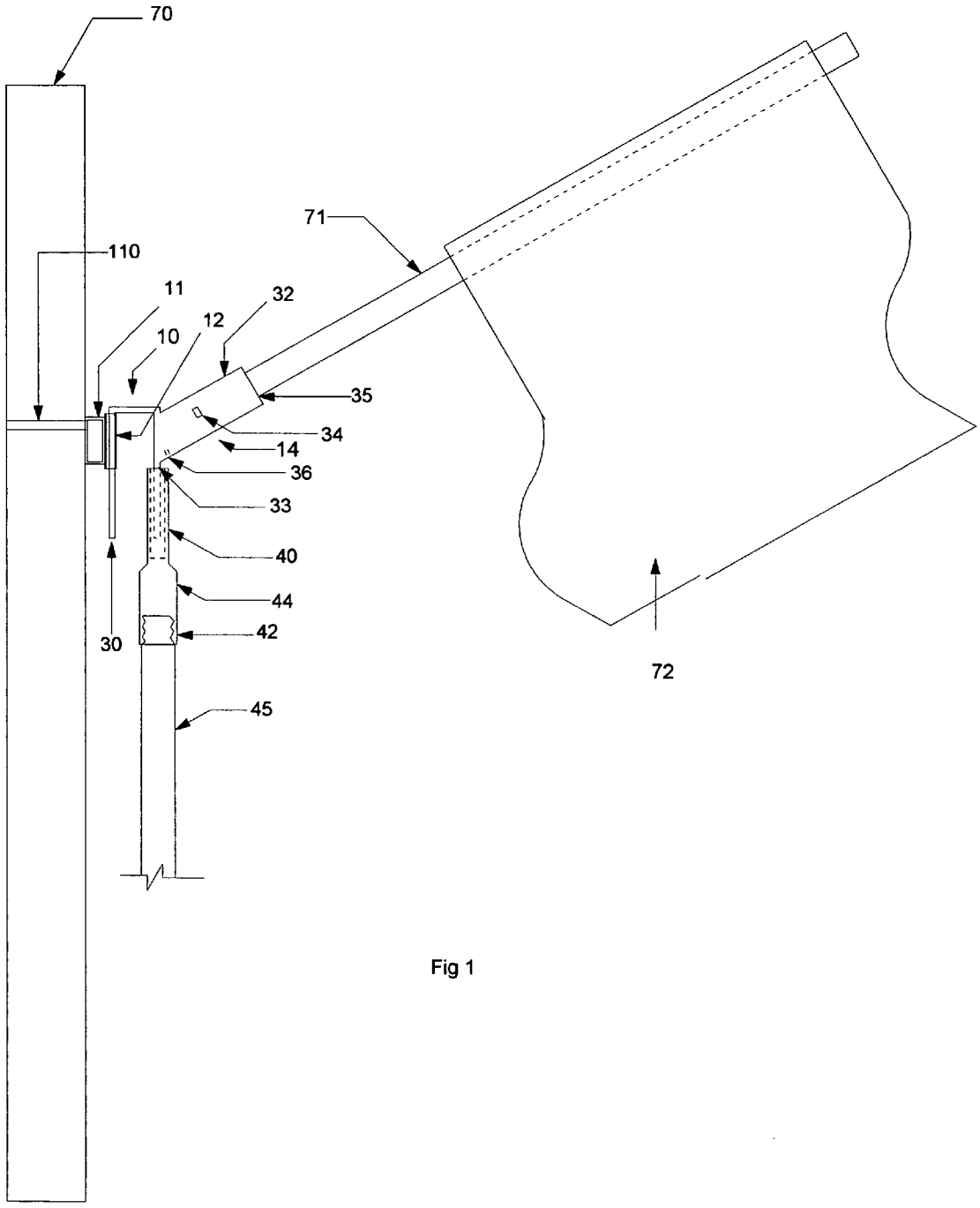
FIG. 1 is a side view of a preferred embodiment of the invention used to hang a flag above the height of a person's head.

In the drawings, like numbers are used to refer to parts having the same function on what may be different embodiments of the invention, as will be apparent from the text set forth below, together with the drawings.

Figure 2A:
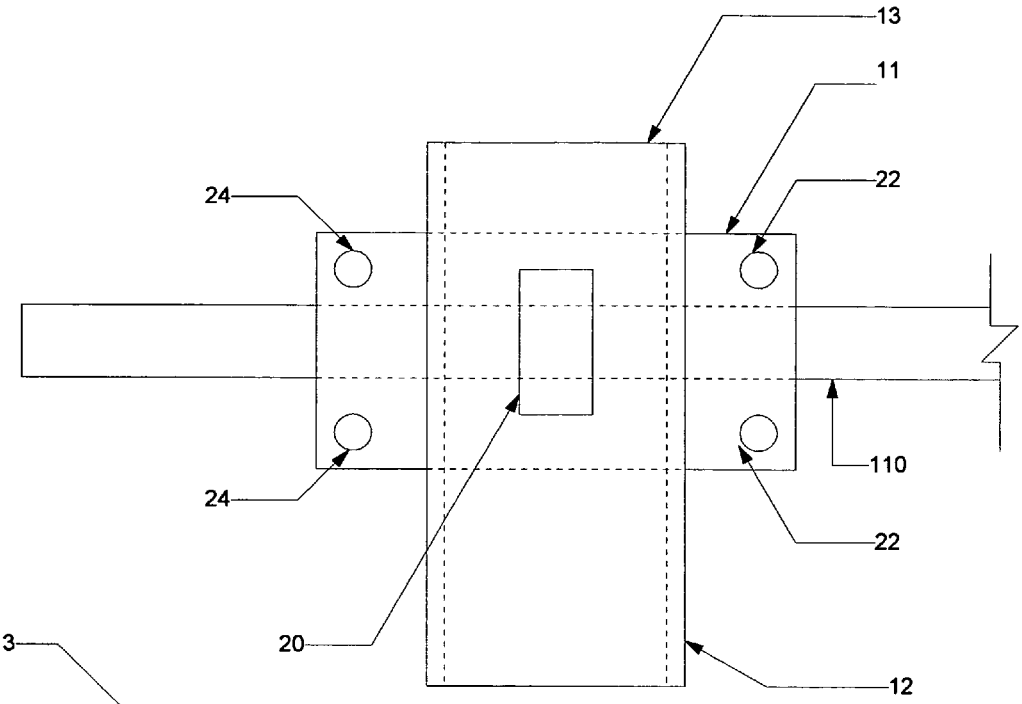
FIGS. 2A and 2B are detailed drawings of the receiver tube and mounting bracket of the device FIG. 1.
Figure 2B:
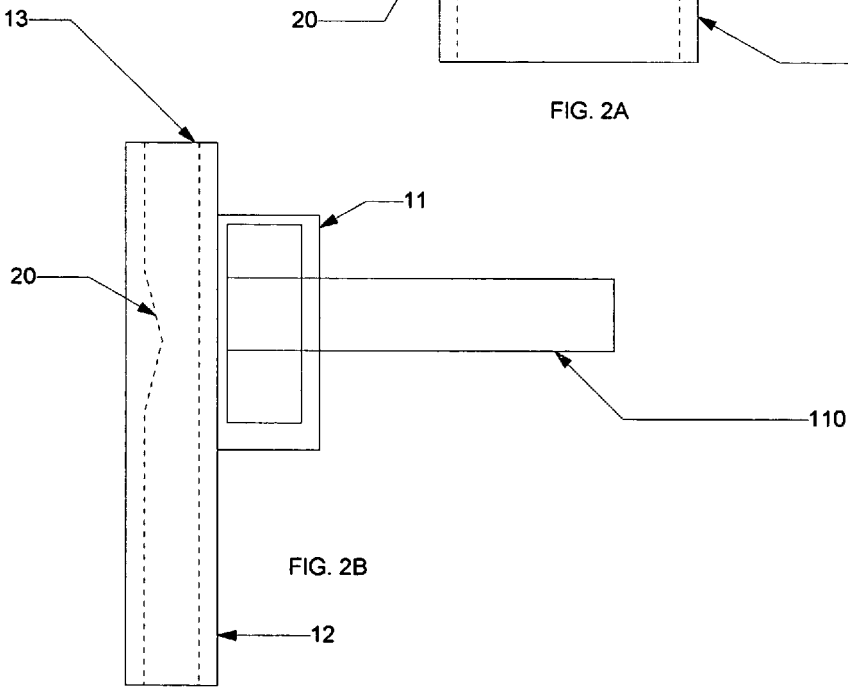
Figure 2C:
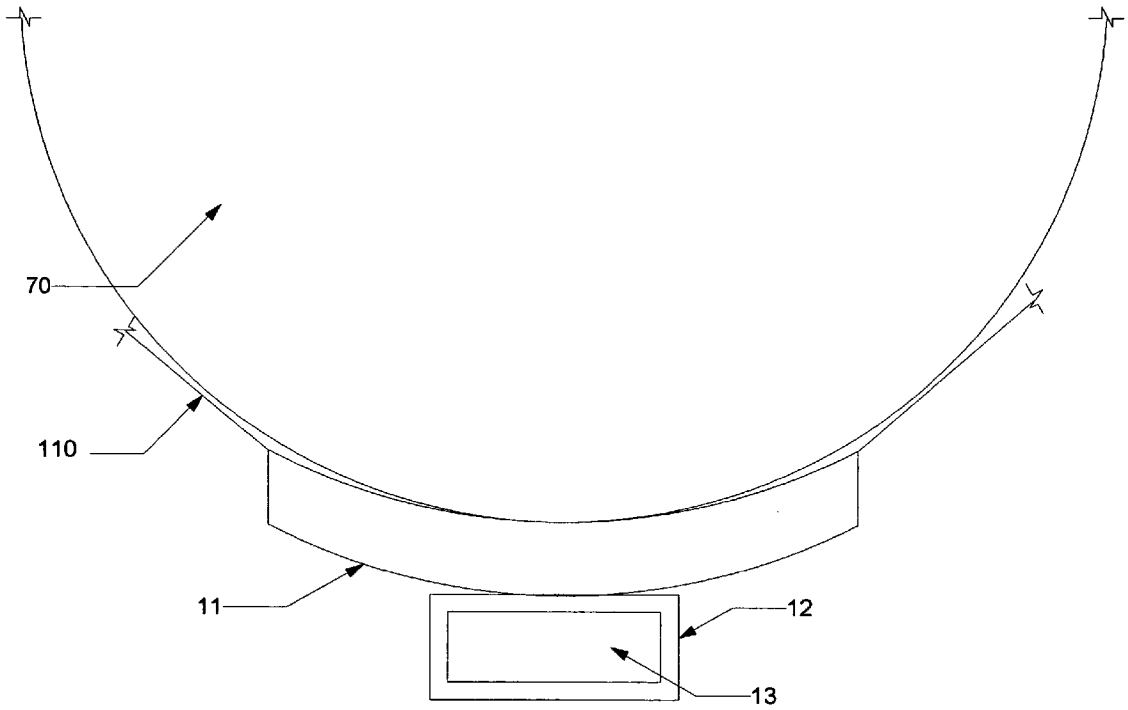
FIG. 2C is a top view of the receiver tube and mounting bracket of FIGS. 2A and 2B mounted to a utility pole.
Figure 3B:
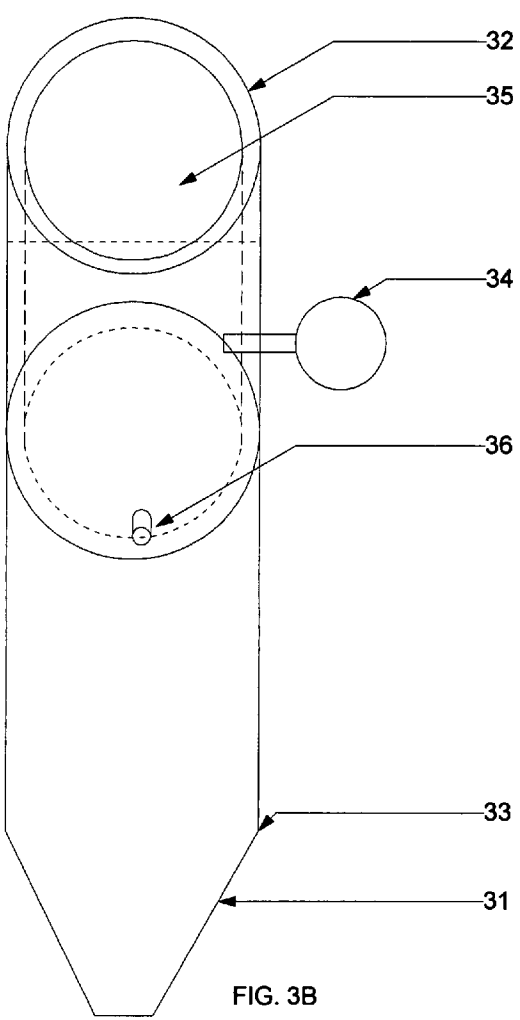
FIGS. 3A and 3B are side and front views, respectively, of the bracket assembly of the device of FIG. 1.
Figure 3A:
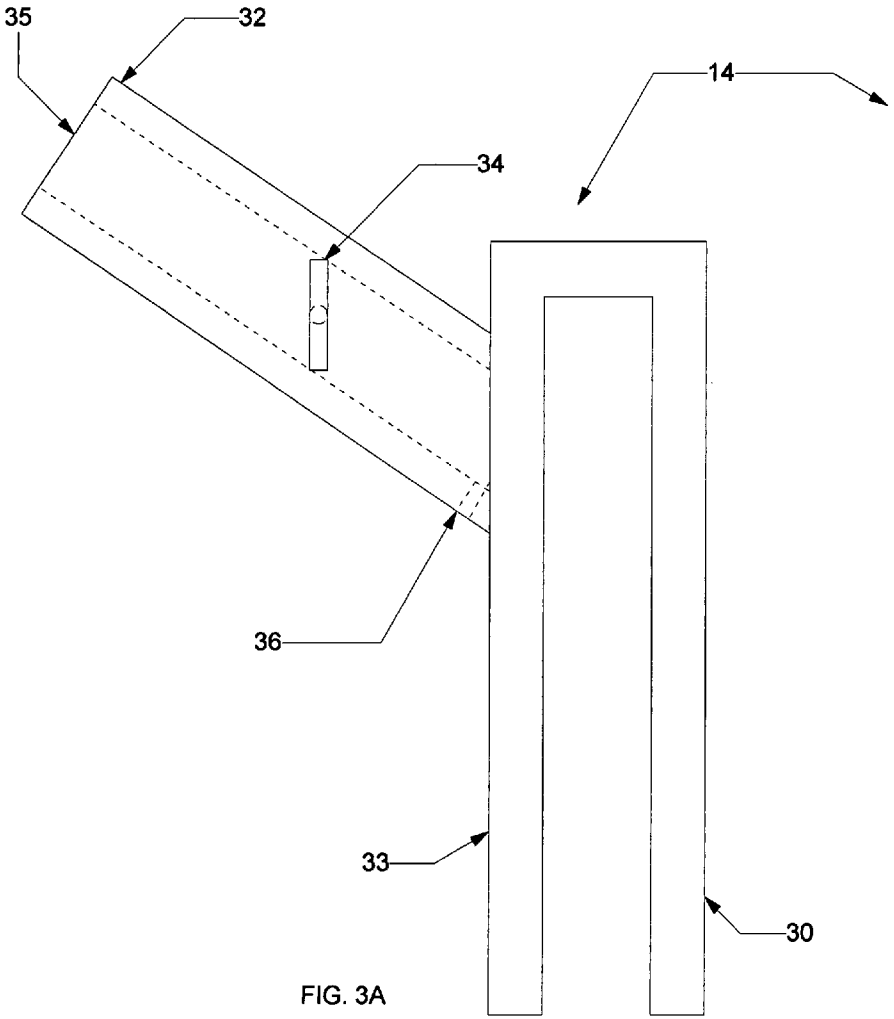

One preferred embodiment of the invention is shown in FIGS. 1–3. Demountable device bracket 10 includes bracket receiver 12 adapted to be directly or indirectly fixed to a surface, and defining an upwardly-facing opening 13. This opening is preferably rectangular or square to prevent rotation of the parts as explained below, although the opening can have other shapes such as round with a key-way or another structure to prevent relative rotation, oval, etc.

The invention also includes a bracket assembly 14 comprising bracket mounting bar 30 having generally the shape of the opening 13 in bracket receiver tube 12, and sized to slide into the upwardly-facing opening of the bracket receiver tube. In this embodiment, bar 30 has tapered end 31 that facilitates its insertion into tube 12. Tube 12 may include inwardly-protruding lock 20 that helps to prevent bar 30 being dislodged from tube 12.

Bracket assembly 14 further comprises a hanger-receiving tube 32 extending at an angle from the exposed portion of mounting bar 30. Tube 32 defines opening 35 that can receive a flagstaff pole or another inserted member. Bracket assembly 14 also includes lifting bar 33 that extends downward from tube 32. Thumbscrew 34 may be included to tightly hold the pole or other member inserted into opening 35. Drain hole 36 drains rainwater from tube 32.

Figure 4A:
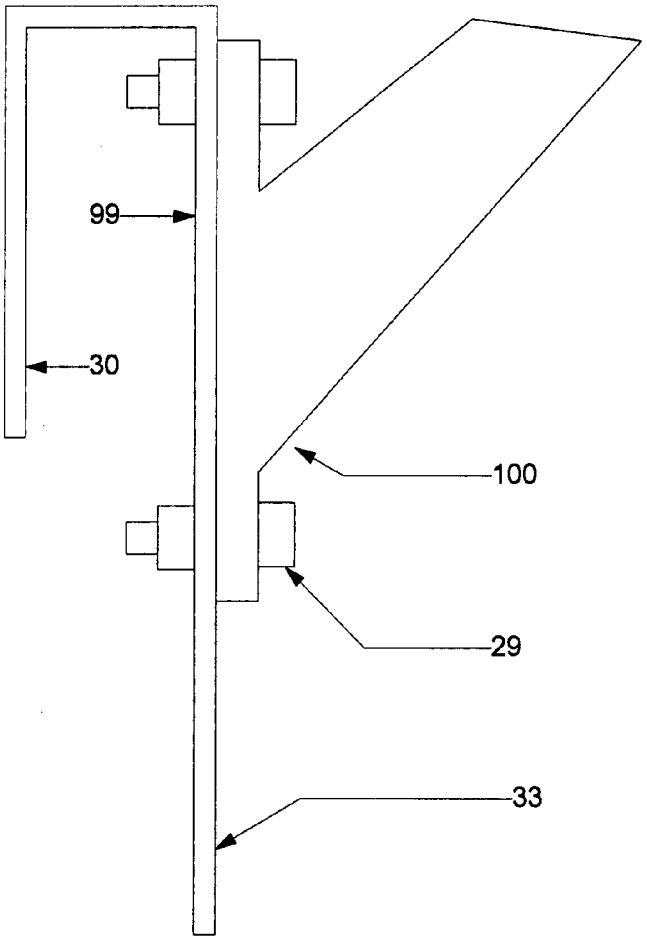
FIGS. 4A–4C are views of an embodiment of the mounting bar of FIG. 1 used to mount an existing flagstaff holder.
Figure 4B:
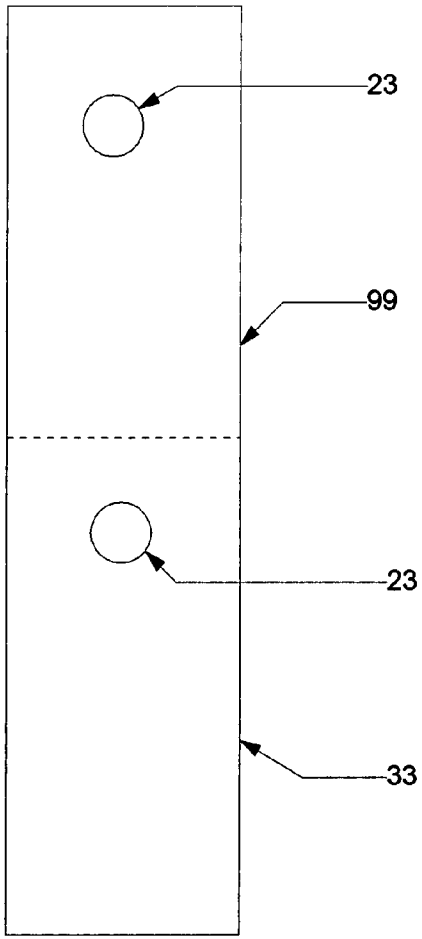
Figure 4C:
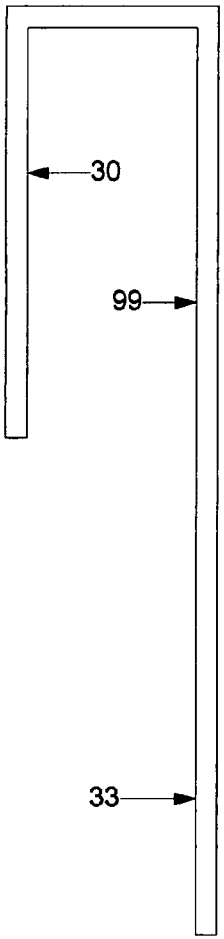

FIGS. 4A and 4B show an alternative embodiment of the demountable bracket of the invention for an existing flagstaff holder 100. This embodiment does not include a hanger receiving tube, but instead has mounting holes such as holes 23 that accept bolts for flagstaff holder 100. Holes 23 are located in flagstaff holder adapter plate 99 that is unitary with lifting bar 33.

Figures 5A, 5B:
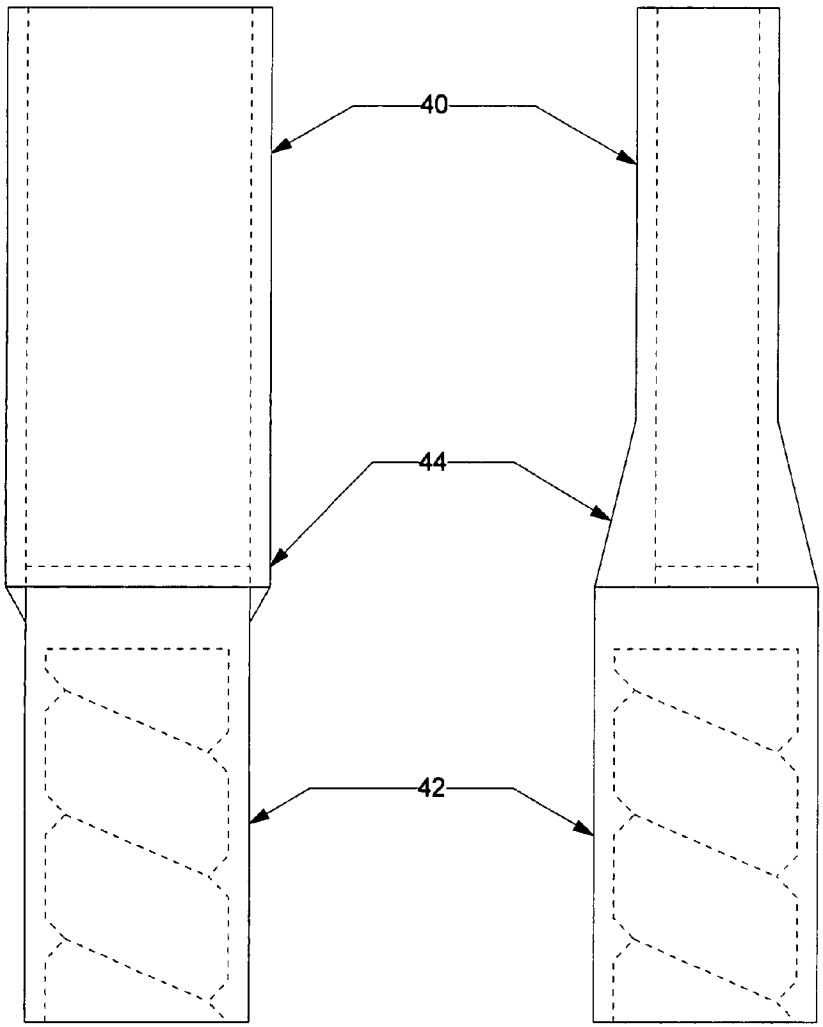

The demountable device bracket of the invention preferably further comprises an elongated lifter 40 (FIGS. 5 and 6) that includes a lifting head assembly 44 that is adapted to couple with lifting bar 33. In this example, lifting head assembly 44 is a tube that fits over bar 33. Also, this embodiment comprises bottom female screw thread member 42 that is internally threaded and can receive the standard threads of a broom or mop handle or the like, so that the user's reach can be extended. The lifter allows the bracket assembly to be lifted up by lifting bar 33 so that bracket mounting bar 30 can be slid into bracket receiver tube 12 above the user's head. This allows a flagstaff or another member that has been inserted into hanger-receiver tube 32, and typically that carries an object such as a flag, banner, birdfeeder, or plant hanger, to be removably held above the ground.

Figures 7A, 7B:
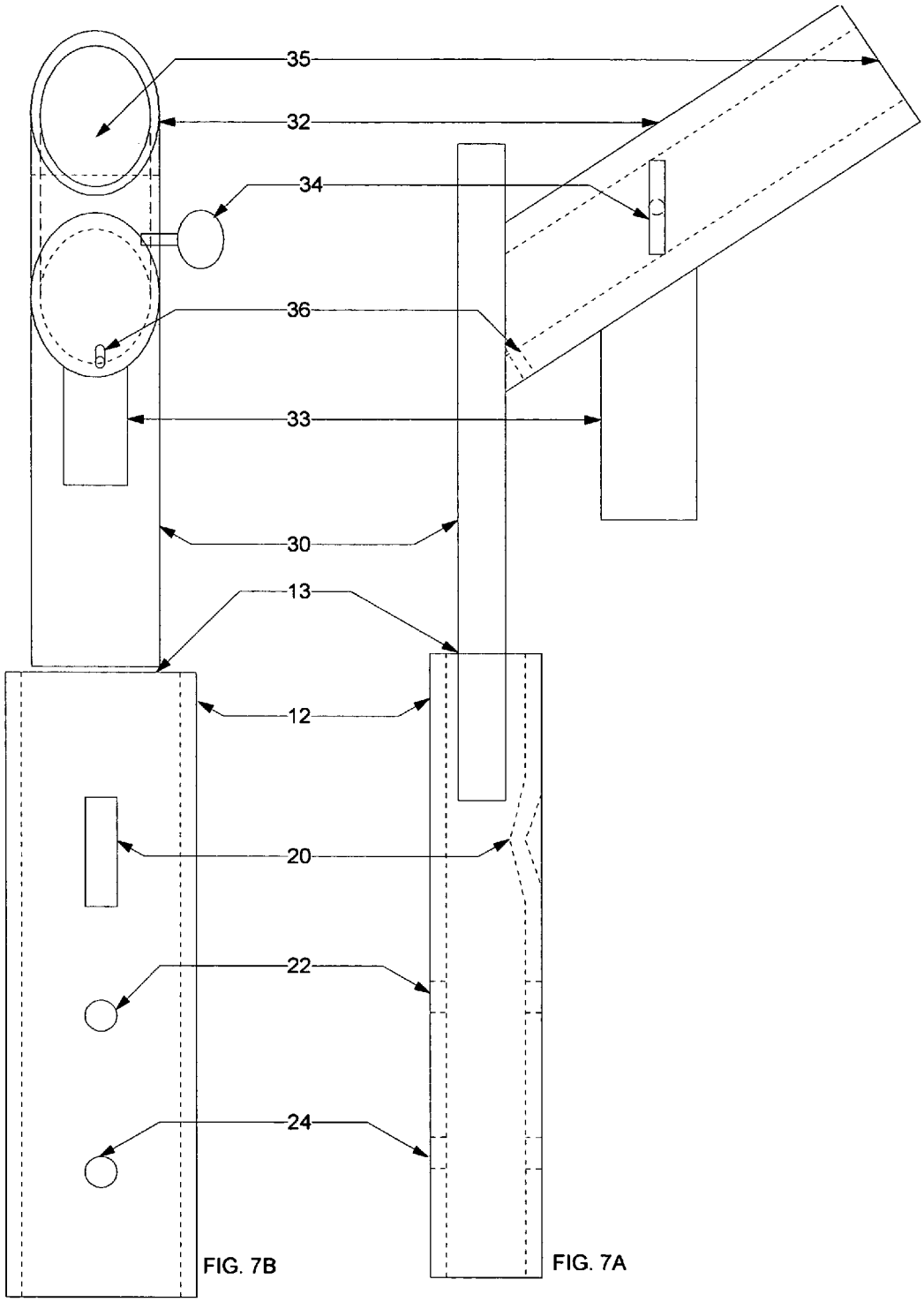
FIGS. 7A and 7B are side and front views, respectively, of the device shown in FIG. 1.

The embodiment of FIGS. 7A and 7B is the preferred rectangular shape of mounting bar 30, and thus of bracket receiver tube 12. These drawings also show in more detail lock 20, which is a narrowing of opening 13 that can be accomplished by deforming a portion of the face of tube 12.

Figure 9:
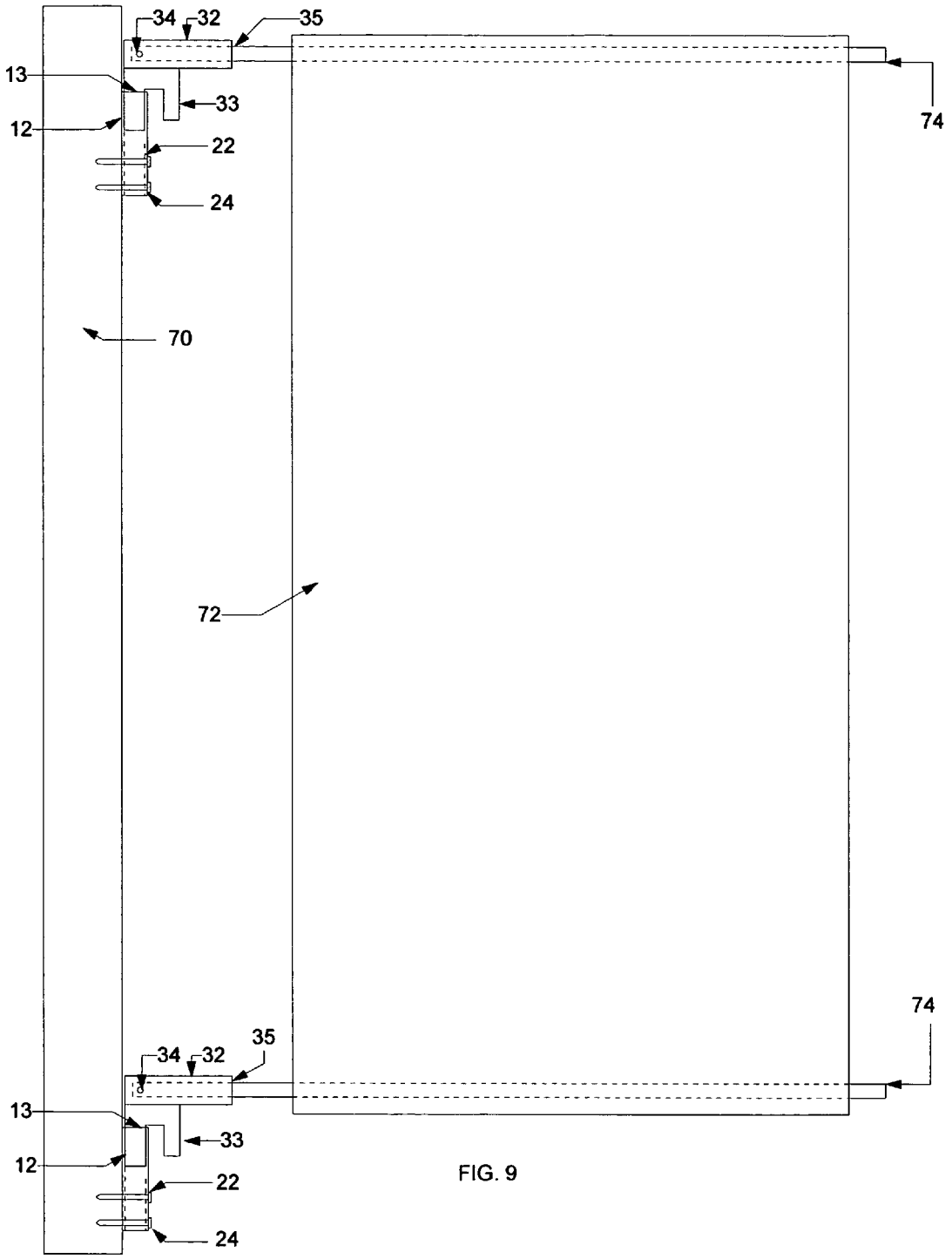
FIG. 9 shows two of the brackets of FIG. 8 in use to hold a banner.

An embodiment of the invention for holding a horizontal tube or shaft is shown in FIG. 8, and in use holding banner 72 in FIG. 9. The difference here is that tube 32 is horizontal. As shown in FIG. 9, two devices can be used to hold a banner or another object 72 between upper and lower inserted banner-carrying shafts 74.

Figures 10A, 10B:
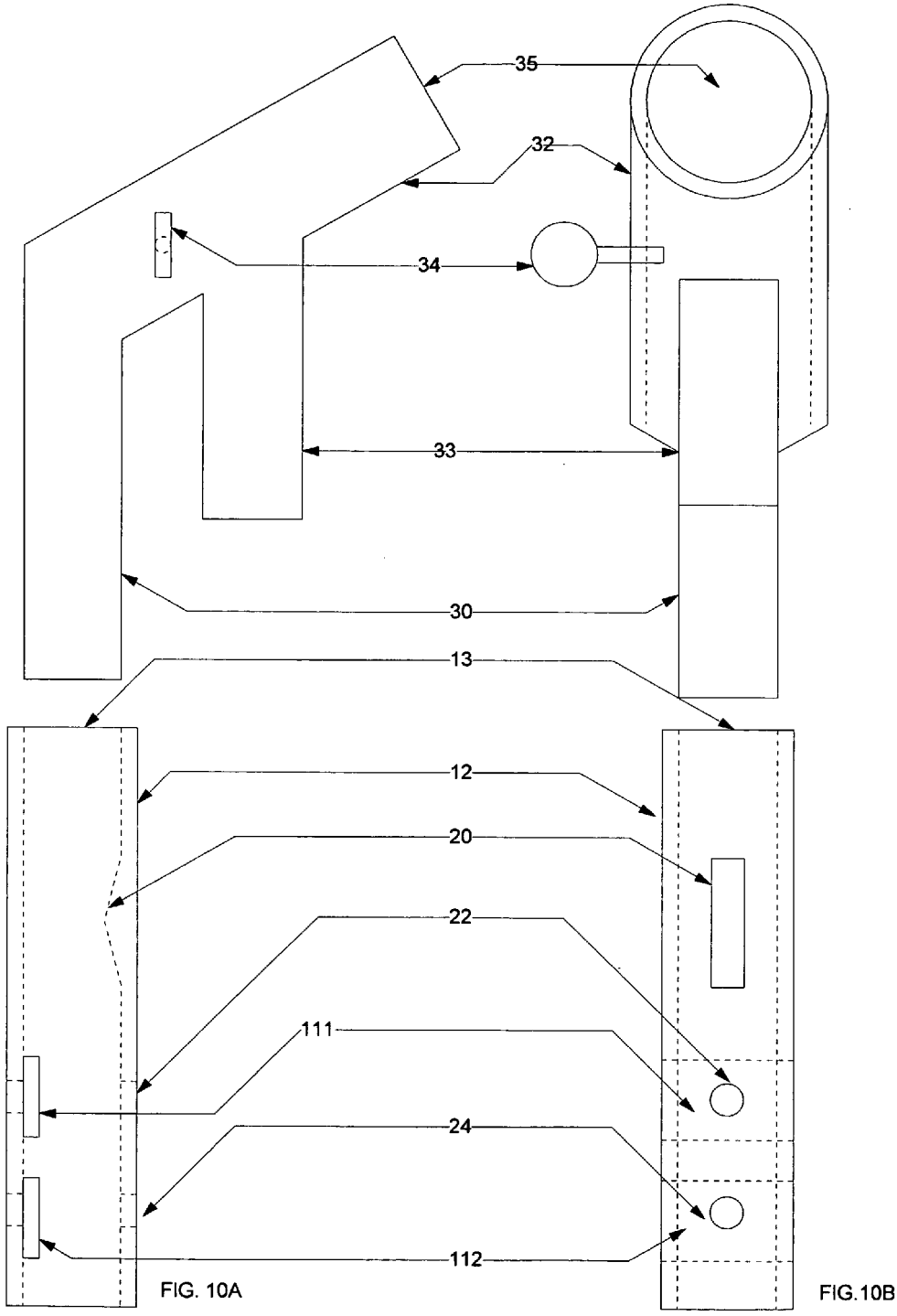
FIGS. 10A and 10B are views of yet another alternative embodiment of the invention using a square shape.

FIG. 10 shows another minor modification using a square tube or bar 30. This embodiment also shows slots 111 and 112 that can accept metal band strap clamps that can be used to mount the device to a utility pole or the like 70, as shown in FIG. 2C. This is an alternative to the use of a rectangular tubular mounting bracket contoured to mount on the pole, part number 11, FIG. 2C.

Figures 8A, 8B, 11A:
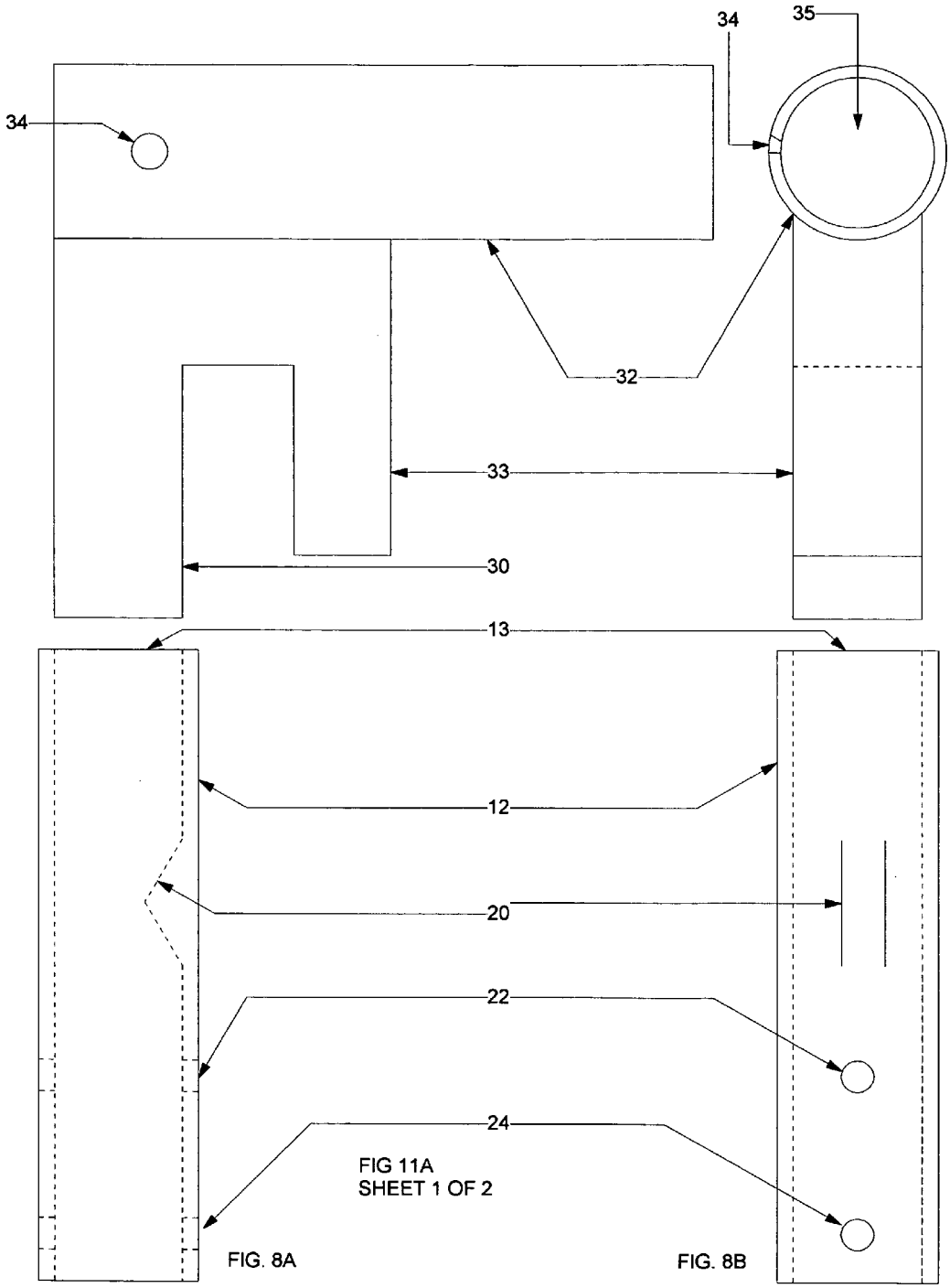
FIGS. 8A and 8B are disassembled side and front views, respectively, of an alternative embodiment of the invention adapted for horizontal mounting of a pole.
FIGS. 11A and 11B are views of an embodiment of the bracket receiver tube of the invention for rectangular tubes.
Figures 11A, 11B:
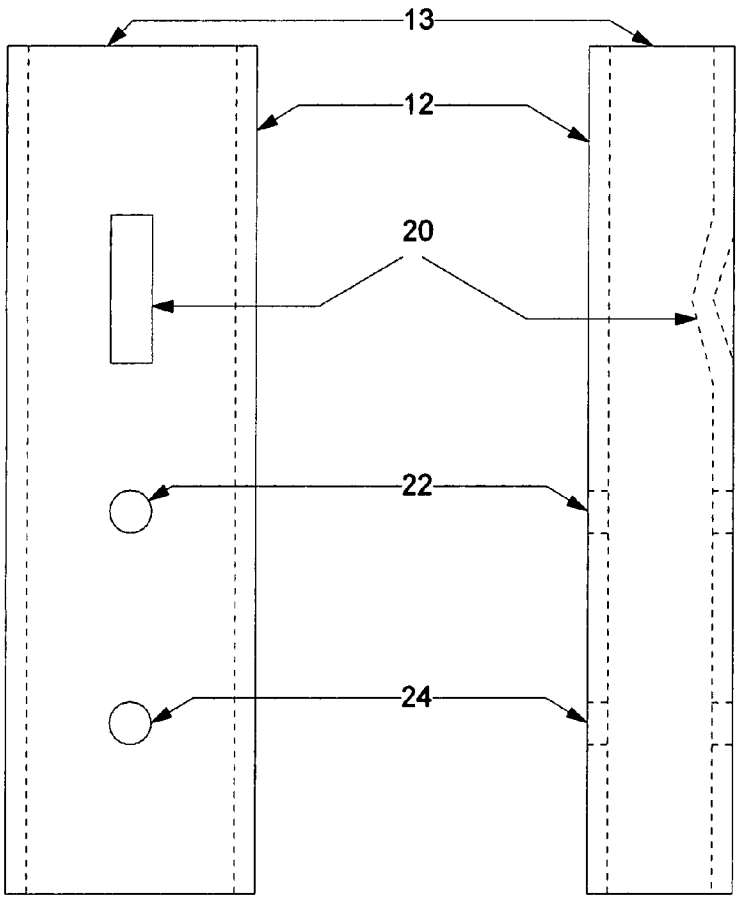

The rectangular bracket of FIG. 7 is shown in more detail in FIGS. 11A and 11B.

Figures 12A, 12B:
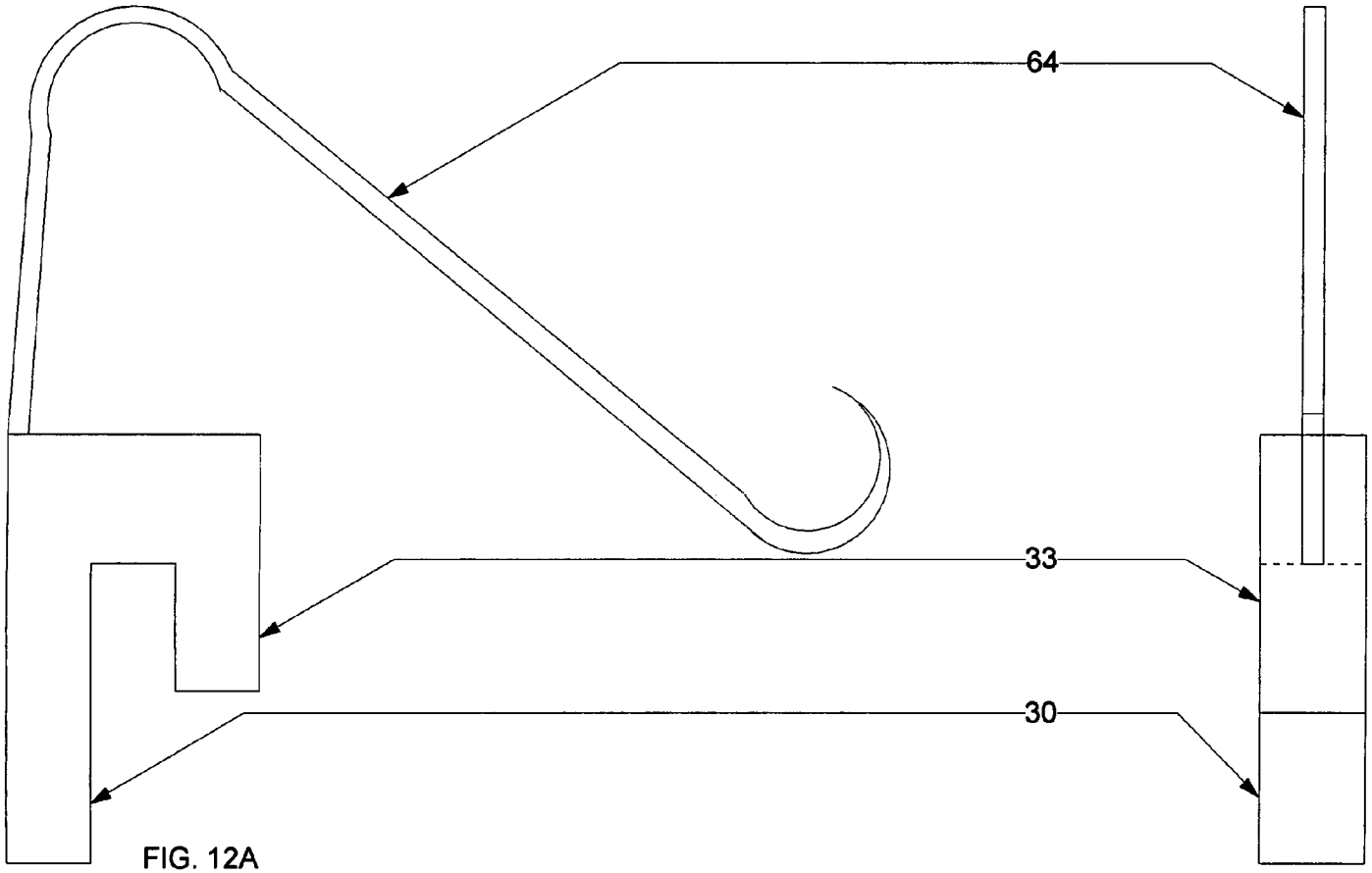
Figures 13A, 13B, 13C:
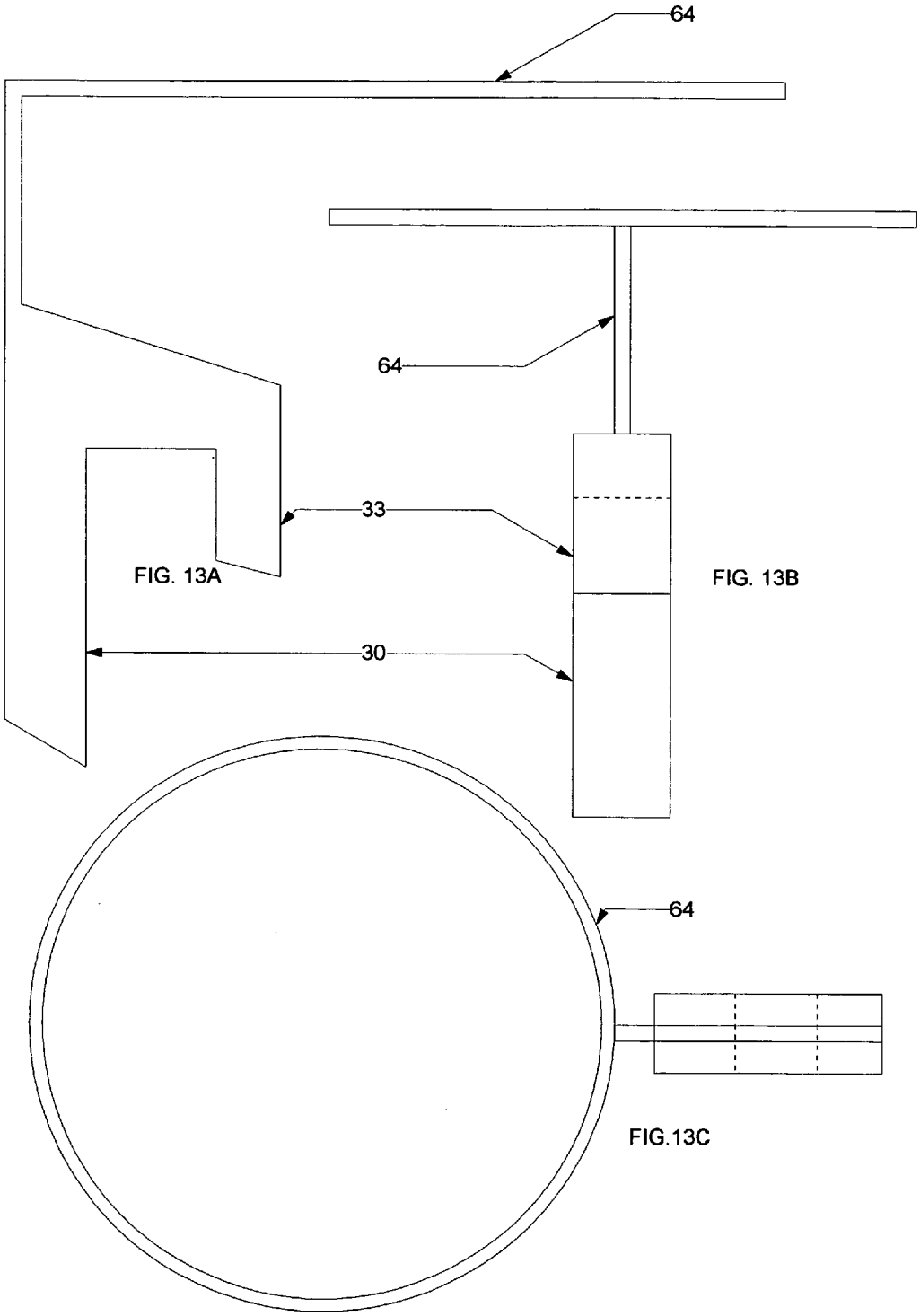
FIGS. 13A–13C show another embodiment for holding potted plants.
Figure 14A:
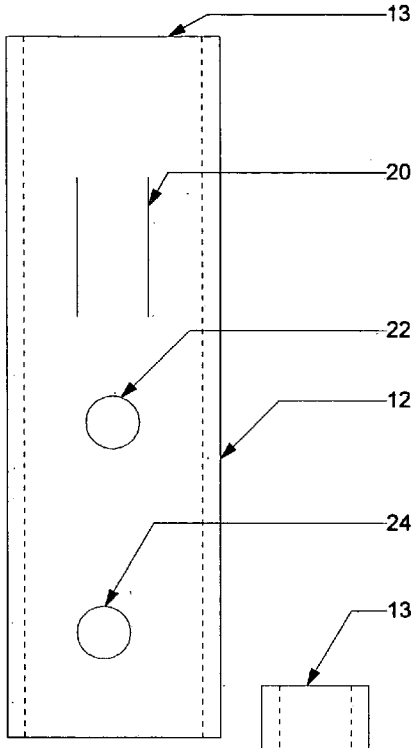
FIGS. 14A–14D show yet another embodiment for use with existing flagstaff holders.
Figure 14B:
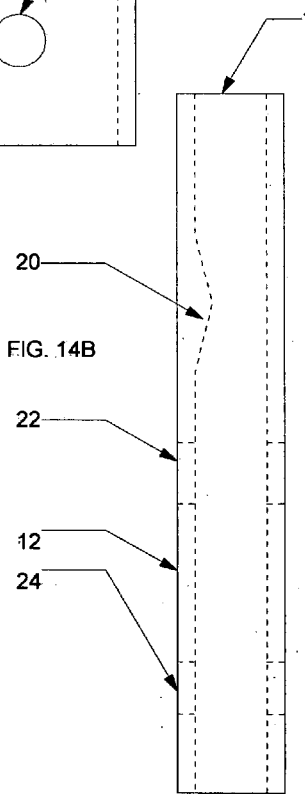
Figure 14D:
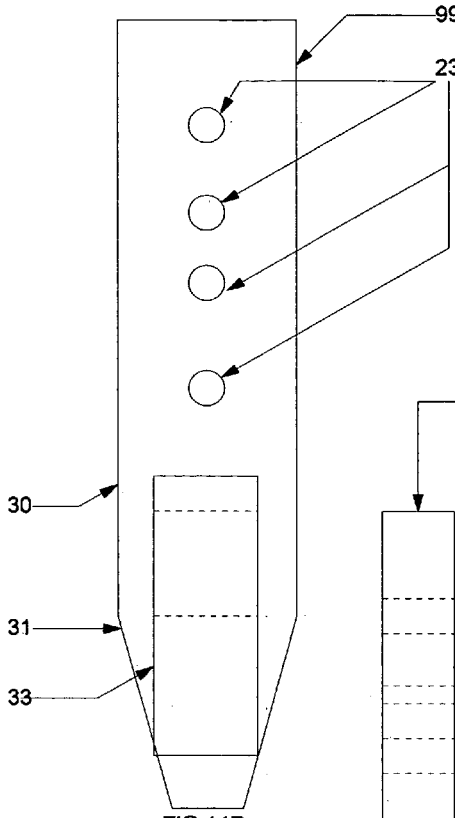
Figure 14C:
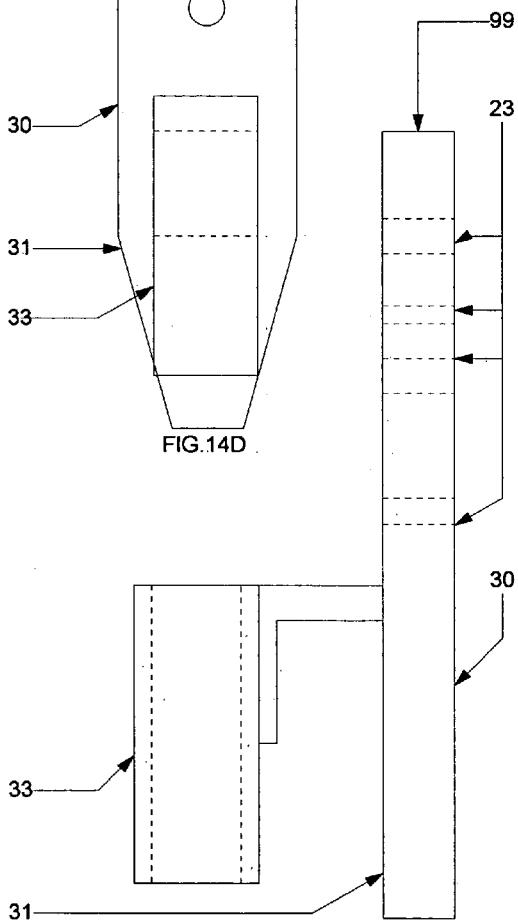

FIG. 12 shows another embodiment carrying hanger bar 64 that in this embodiment has a hook at its end on which can be hung the hook of a plant hanger or the like. A similar embodiment shown in FIG. 13 configures bar 64 to define an annular ring into which can be placed the pot of a potted plant or the like.

Another embodiment of a device that can be used with existing flagstaff holders is shown in FIG. 14. This embodiment includes four mounting holes 23 to accommodate different designs of flagstaff holders.

Figures 15A, 15B:
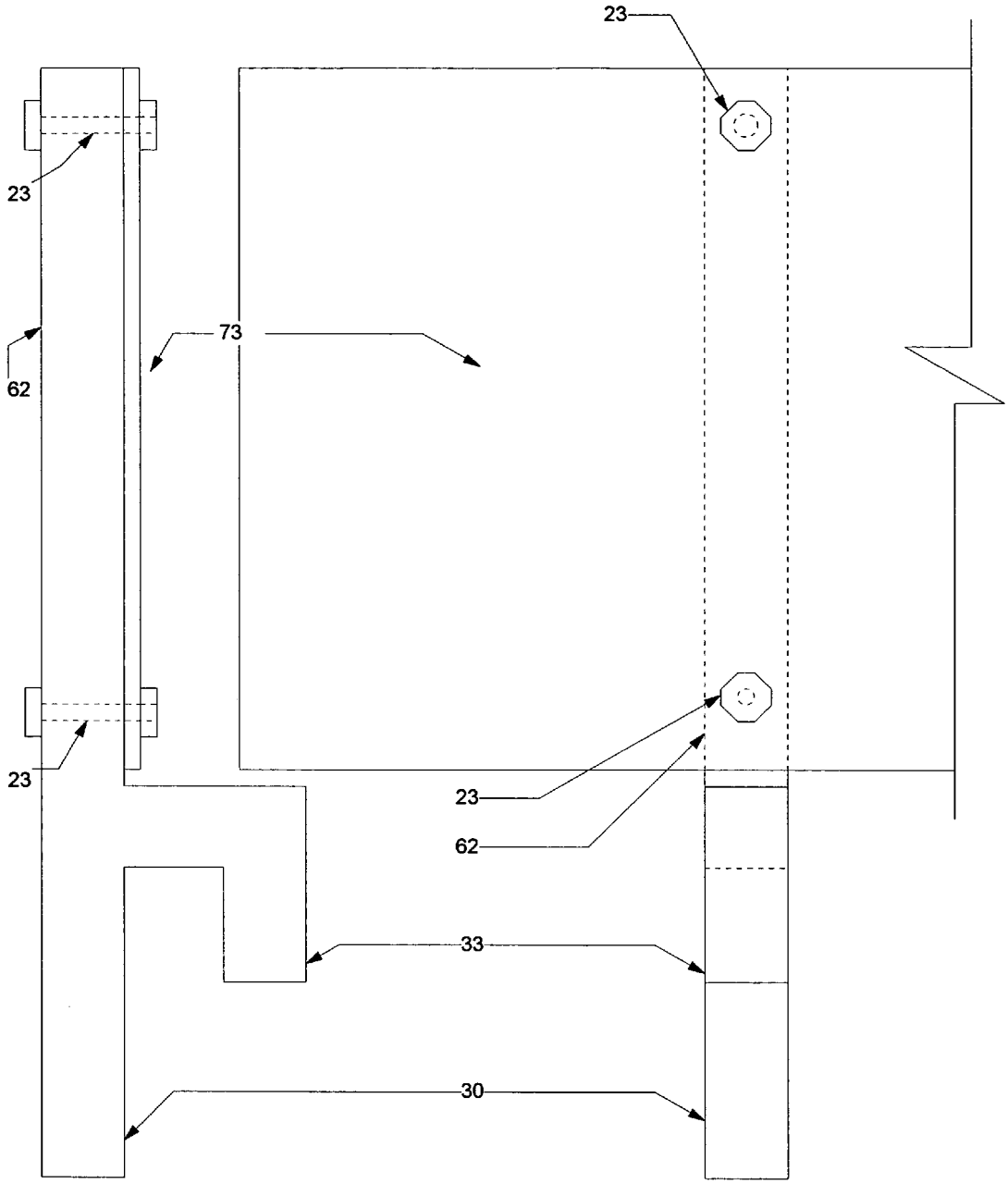
FIGS. 15A and 15B show yet another embodiment for use as a demountable bracket for signs.

Yet another embodiment adapted to hold a rigid sign or poster or the like 73 is shown in FIGS. 15A and 15B. The sign is bolted to vertically extending section 62 that has mounting holes 23 for accepting bolts or other fasteners that hold sign 73 to section 62.

Figures 16A, 16B:
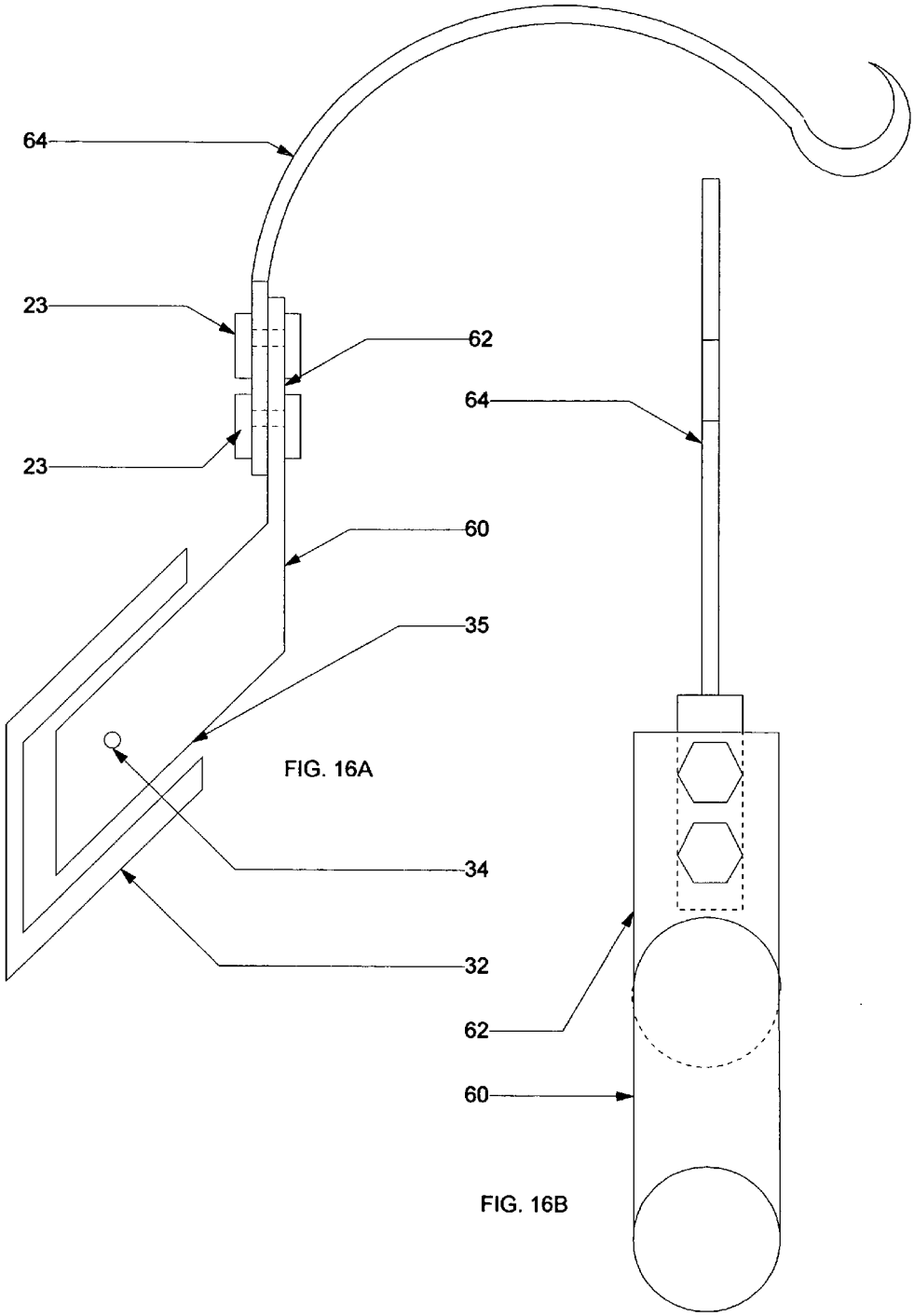
FIGS. 16A and 16B show another embodiment useful as a universal mounting device.

FIGS. 16A and B show a universal mounting device 60 that is sized and shaped to fit into opening 35 of hanger-receiving tube 32. This includes vertically extending section 62 with two mounting holes that can accept any number of devices, in this case the hook-shaped bar 64. This universal mounting device can be configured with preformed holes 23, or can be drilled to accept the mounting holes of the particular flagstaff holder, mounting bar or another bracket or device. The inclusion of vertically extending section 62 on short tube 60 adapts such bracket or device to be removably held in the inventive bracket.

Figures 17A, 17B, 17C, 17D:
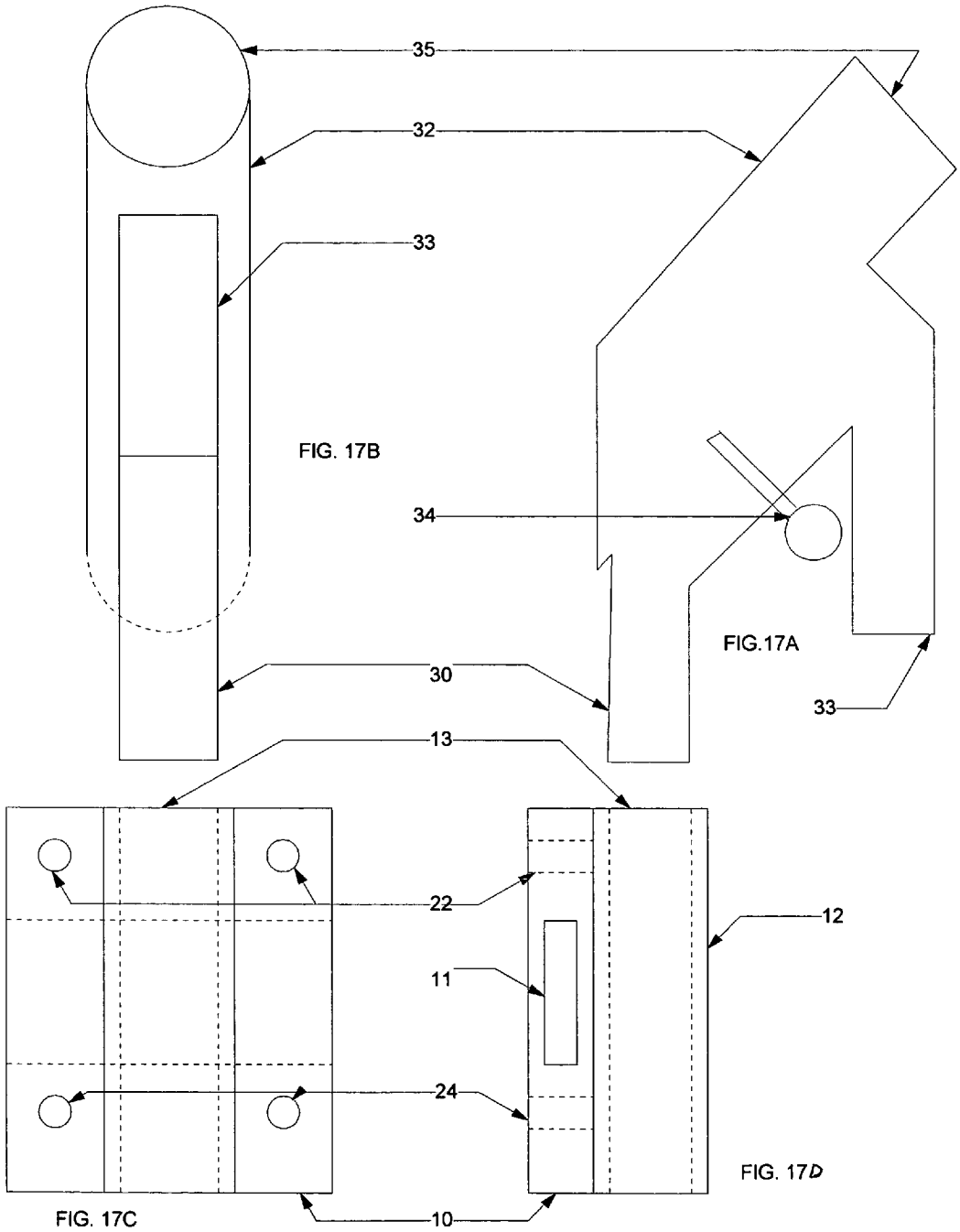
FIGS. 17A–17D show another embodiment with a rectangular base.
Figure 19A:
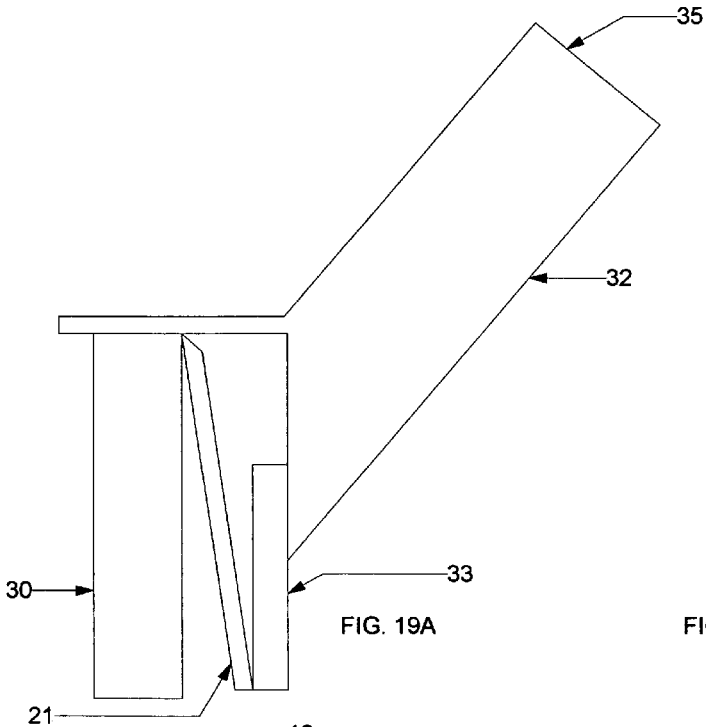
FIGS. 19A–19D show yet another embodiment having a locking device to help inhibit removal of the bracket assembly from the bracket receiver tube.
Figure 19B:
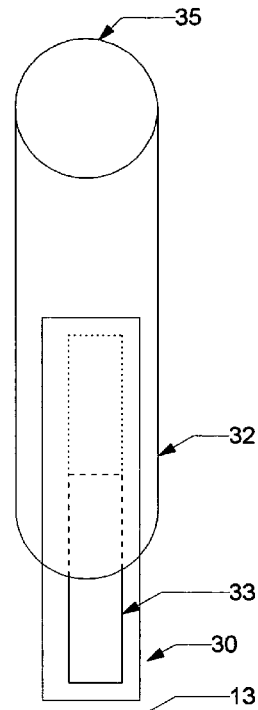
Figure 19D:
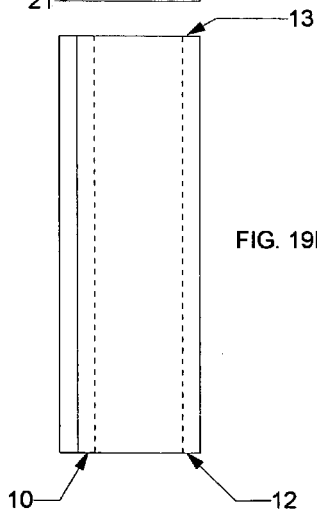
Figure 19C:
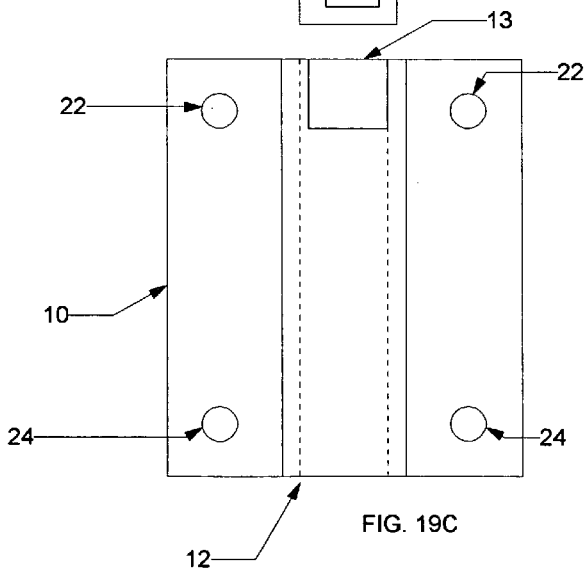

More stability in the device can be accomplished with a larger bracket receiver tube 12 as shown in FIG. 17. This design can accommodate more weight or more wind load or the like.

Yet another embodiment that is appropriate for use with existing flagstaff holders and the like is shown in FIG. 18. This is another means of carrying a flagstaff holder adapter plate 99 having hardware-receiving openings 23.

An embodiment that accomplishes a releasable mechanical locking of the bracket receiver tube in the mounting bracket is shown in FIG. 19. Pivoting spring locking arm 21 is coupled at its lower end to lifting bar 33. The spring force of arm 21 applies pressure to the outside of receiver tube 12 when mounting bar 30 is in tube 12. This helps to prevent bar 30 from lifting out of tube 12 due to wind loading or other potential forces. Arm 21 is released from tube 12 by lifting head 44 when it is pushed up over bar 33.

Although features of the invention are shown in some drawings and not others, this is for convenience and is not a limitation of the invention, which is defined by the following claims.

What is claimed is:

1. A demountable device bracket, comprising:

a. a bracket receiver tube adapted to be fixed to a surface, and defining an upwardly-facing opening having an opening shape; and b. a bracket assembly comprising:

i. a bracket mounting bar having generally the shape of the opening in the bracket receiver tube, and sized to slide into the upwardly-facing opening of the bracket receiver tube;

ii. a hanger-receiving tube extending at an angle from the exposed portion of the mounting bar, defining an opening that can receive a pole or bar; and iii. a lifting bar extending downward from the hanger-receiving tube;

wherein the bracket mounting bar can be slid into the bracket receiver tube, to allow a pole or bar or other structure that is inserted into the hanger-receiving tube and that carries an object such as a flag, banner or birdfeeder, to be removably held above the ground.

2. The demountable device bracket of claim 1, further comprising:

c. an elongated lifter comprising a lifting head assembly adapted to couple with the lifting bar, wherein the lifter supports the bracket assembly for lifting, so that the bracket mounting bar can be lifted up into a bracket receiver tube above the user's head.

3. The demountable device bracket of claim 1 wherein the bracket receiver tube defines a generally rectangular opening.

4. The demountable device bracket of claim 1 wherein the bracket receiver tube defines a generally square opening.

5. The demountable device bracket of claim 1 wherein the bracket receiver tube defines a locking structure.

6. The demountable device bracket of claim 1 wherein the hanger-receiving tube defines a generally round opening.

7. The demountable device bracket of claim 1 wherein the hanger-receiving tube further includes a set screw device for maintaining a structure therein.

8. The demountable device bracket of claim 1 wherein the lifting bar is generally rectangular.

9. The demountable device bracket of claim 1 wherein the hanger-receiving tube is at an angle.

10. The demountable device bracket of claim 1 wherein the hanger-receiving tube is generally horizontal.

11. The demountable device bracket of claim 1, further comprising a universal mounting device held in the hanger-receiving tube and comprising a short tube and an extending portion to which can be coupled another structure.

12. A demountable device bracket, comprising:

a. a mounting bracket adapted to be fixed to a surface, and a bracket receiver tube coupled to the mounting bracket and defining an upwardly-facing opening having an opening shape; and b. a bracket assembly comprising:

i. a bracket mounting bar having generally the shape of the opening in the bracket receiver tube, and sized to slide into the upwardly-facing opening of the bracket receiver tube;

ii. a hanger-receiving tube extending at an angle from the exposed portion of the mounting bar, defining an opening that can receive a pole or bar; and iii. a lifting bar extending downward from the hanger-receiving tube;

wherein the bracket mounting bar can be slid into the bracket receiver tube, to allow a pole or bar or other structure that is inserted into the hanger-receiving tube and that carries an object such as a flag, banner or birdfeeder, to be removably held above the ground.

13. The demountable device bracket of claim 12, wherein the mounting bracket defines one or more openings through which are placed one or more strap clamps, to allow the device bracket to be coupled to a pole around which the strap clamp is passed.

14. A demountable device bracket, comprising:

a. a bracket receiver tube adapted to be fixed to a surface, and defining an upwardly-facing opening having an opening shape; and b. a bracket assembly comprising:

i. a bracket mounting bar having generally the shape of the opening in the bracket receiver tube, and sized to slide into the upwardly-facing opening of the bracket receiver tube;

ii. an adapter extending from the exposed portion of the mounting bar, to which another structure can be coupled; and iii. a lifting bar extending downward;

wherein the bracket mounting bar can be slid into the bracket receiver tube, to allow a structure that is coupled to the adapter to be removably held above the ground.

15. The demountable device bracket of claim 14, wherein the lifting bar is integral with and below the adapter.

16. The demountable device bracket of claim 14, further comprising:

c. an elongated lifter comprising a lifting head assembly adapted to couple with the lifting bar, wherein the lifter supports the bracket assembly for lifting, so that the bracket mounting bar can be lifted to a bracket receiver tube above the user's head.

* * * * *